US006494618B1

(12) United States Patent
Moulton

(10) Patent No.: US 6,494,618 B1
(45) Date of Patent: Dec. 17, 2002

(54) HIGH VOLTAGE RECEPTACLE FOR X-RAY TUBES

(75) Inventor: Paul C. Moulton, Magna, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 24 days.

(21) Appl. No.: 09/639,185

(22) Filed: Aug. 15, 2000

(51) Int. Cl.[7] ..... H05G 1/00
(52) U.S. Cl. ..... 378/204; 378/203; 378/194
(58) Field of Search ..... 378/204, 194, 378/203

(56) References Cited

U.S. PATENT DOCUMENTS

| | | | | | |
|---|---|---|---|---|---|
| 4,335,928 | A | | 6/1982 | Barrett et al. | 339/94 |
| 4,362,348 | A | | 12/1982 | Stephenson et al. | 339/75 |
| 4,494,811 | A | * | 1/1985 | Palermo, Jr. | 339/94 R |
| 4,767,961 | A | * | 8/1988 | Koller | 313/12 |
| 5,154,638 | A | * | 10/1992 | Sireul et al. | 439/611 |
| 5,162,267 | A | * | 11/1992 | Smyth | 501/45 |
| 5,310,361 | A | * | 5/1994 | Muchowicz et al. | 439/610 |
| 5,358,419 | A | | 10/1994 | Pejsa et al. | 439/201 |
| 5,384,820 | A | | 1/1995 | Burke | 378/135 |
| 5,553,114 | A | | 9/1996 | Siemers et al. | 378/129 |
| 5,707,252 | A | * | 1/1998 | Meszaros | 439/610 |
| 5,876,229 | A | * | 3/1999 | Negle | 439/281 |
| 6,213,805 | B1 | * | 4/2001 | Jedlitschka et al. | 439/271 |

* cited by examiner

*Primary Examiner*—Robert H. Kim
*Assistant Examiner*—Irakli Kiknadze
(74) *Attorney, Agent, or Firm*—Workman, Nydegger & Seeley

(57) ABSTRACT

The present invention provides devices for improved radiation attenuation in devices which generate x-ray radiation. A high voltage receptacle is disclosed, the receptacle being adapted to accommodate a high voltage connector to supply power to an x-ray tube and being formed of a mixture of a dielectric material and an x-ray attenuating material, such as an x-ray attenuating metal compound. X-ray radiation impinging upon the high voltage receptacle that would otherwise pass through the unshielded receptacle is absorbed or scattered by the x-ray attenuating material without the need for additional x-ray shielding. Also disclosed is an x-ray housing assembly including an x-ray housing adapted to contain an x-ray tube, and a high voltage receptacle, wherein the high-voltage receptacle and optionally a portion of the x-ray housing is formed of a mixture of a dielectric material and an x-ray attenuating material.

24 Claims, 4 Drawing Sheets

HIGH VOLTAGE RECEPTACLE FOR X-RAY TUBES

BACKGROUND OF THE INVENTION

1. The Field of the Invention

The present invention relates generally to x-ray tubes. More particularly, the present invention relates to a high voltage connector receptacle having combined radiation attenuating and dielectric properties, and to an x-ray tube housing incorporating the high voltage connector receptacle.

2. The Relevant Technology

X-ray generating devices are used in a variety of medical and industrial applications. A typical x-ray device consists of an x-ray tube disposed within an outer housing, sometimes referred to as the "can." The x-ray tube itself is usually comprised of an evacuated housing that encloses an anode and a cathode. The outer housing/can is typically filled with a dielectric oil, or similar coolant, to remove heat from the x-ray tube during operation. Electrical leads are provided through the outer housing and connected to the x-ray tube so that in operation, power can be supplied to a filament portion of the cathode, thereby causing the release of electrons by thermionic emission. Electrical leads are also connected to the x-ray tube in a manner so as to provide a voltage potential between the cathode and the anode. The voltage potential causes the released electrons to accelerate towards the anode at high speeds. Upon striking the target surface of the anode, which is comprised of a material having a high atomic number, a portion of the resulting kinetic energy is converted to electromagnetic waves of very high frequency, i.e., x-rays.

The resulting x-rays emanate from the target surface, and are then collimated through windows formed through the evacuated housing and the outer housing for penetration into an object, such as a patient's body. As is well-known, the x-rays that pass through the object can be detected and analyzed so as to be used in any one of a number of applications, such as x-ray medical diagnostic examinations or material analysis procedures.

Although a majority of the generated x-rays are emitted from the target surface so as to be directed towards the x-ray transmission windows, some of the x-rays may be directed in other directions. These "off focus" x-rays can potentially present health hazards to nearby personnel, including equipment operators and patients, and are thus preferably attenuated so that they are not released from the x-ray device. For example, the outer housing/can may be provided with a shielding or liner made from an x-ray absorbing material, such as lead or a similar dense material. However, the use of such materials (e.g., lead) can be problematic. For instance, care must be taken in the manufacturing and assembly processes to protect workers and the environment from excessive lead exposure. Further, care must be taken in the disposal of such potentially hazardous materials. Moreover, it is difficult in practice to effectively shield all parts of the x-ray device to completely prevent x-rays from exiting in unwanted locations. In particular, the electrical leads or conductors used to provide the filament power and the high voltage potentials to the x-ray tube must be supplied via connectors through a openings formed through the x-ray tube housing. Because of the high voltages involved, to avoid arcing and/or related electrical problems, such connectors are usually provided in the form of a receptacle that is made of a dielectric material. Unfortunately, and depending upon the specific geometry of the x-ray device, a fraction of the off-focus x-rays produced can travel along paths that can allow them to escape the x-ray tube housing through the openings provided to accommodate the high voltage receptacle/connector. Consequently, further shielding of the high voltage receptacle is required. However, this adds additional cost and complexity to the manufacturing and assembly process, and often entails more extensive handling of, and consequent exposure to, lead materials by assembly personnel.

Thus, it would be an improvement in the art to provide a high voltage receptacle that effectively prevents x-rays from exiting the x-ray device. Moreover, it would be desirable if the connector would be implemented in a manner such that the additional costs, complexities, and health risks associated with conventional x-ray shielding materials—such as lead—were minimized.

OBJECTIVES AND SUMMARY OF EMBODIMENTS OF THE INVENTION

It is therefore a general objective of the present invention to provide a high voltage receptacle for use with an x-ray device that is capable of attenuating x-ray radiation.

Another objective is to provide a high voltage receptacle that does not require the use of lead lining or separate shielding structures to provide x-ray attenuation.

Still another objective is to provide a receptacle that is comprised of a dielectric material that permits use in the high voltage environment of an x-ray tube.

A related objective is to provide an x-ray tube housing assembly formed integrally with the high voltage receptacle so as to provide improved attenuation of off-focus radiation.

In accordance with these and other objects, embodiments of the present invention are directed to high voltage receptacles and x-ray tube housing assemblies wherein at least a portion of the receptacle or housing assembly is formed of a material having both dielectric and radiation attenuating properties. In one embodiment, the present invention provides a high voltage receptacle formed of a dielectric material, such as a dielectric thermoset plastic, which is doped or filled with an x-ray attenuating material, such as a metal-containing compound. In a preferred embodiment, the high voltage receptacle is molded from a mixture of a dielectric plastic and a heavy metal sulfate or oxide, thereby providing both dielectric and radiation attenuating properties within a single structure. This eliminates the need for additional radiation shielding components, such as lead liners or shields, and thus minimizes related health and/or environmental risks. Moreover, the elimination of traditional shielding components reduces the manufacturing complexity and costs.

In another preferred embodiment, an x-ray tube housing assembly having an x-ray tube housing and a high voltage receptacle is provided. In this embodiment, the high voltage receptacle and at least a portion of the x-ray tube housing are formed as a single integral structure from the dielectric material and an x-ray attenuating material. Again, this provides for an improved and less complex assembly that exhibits superior shielding of off-focus x-rays.

Preferred embodiments of the present invention use conventional dielectric materials such as thermoset plastics in combination with metal-containing compounds having good radiation attenuation properties, such as heavy metal sulfates and heavy metal oxides. Preferred metals include lead, bismuth, barium, tellurium and strontium, and preferred x-ray attenuating compounds include lead oxide, bismuth oxide, barium sulfate, tellurium oxide and strontium sulfate.

hi practice, the combination of a dielectric material and an x-ray attenuating material in the high voltage receptacle and optionally in a portion of the x-ray tube housing essentially prevents x-rays from exiting the x-ray device through the receptacle opening.

These and other objects, features and advantages of the present invention will become more fully apparent from the following description and appended claims, or may be learned by the practice of the invention as set forth hereinafter.

BRIEF DESCRIPTION OF THE DRAWINGS

In order to illustrate the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Presently preferred embodiments of the present invention provide high voltage receptacles and x-ray tube housing assemblies having improved radiation attenuating properties. The improved radiation attenuation is achieved by forming the high voltage receptacle, and optionally a portion of the x-ray tube housing, from a combination of a dielectric material and an x-ray attenuating material, thereby providing improved radiation attenuation without the need for additional costly, and potentially hazardous, lead shielding components and materials.

Figure 1:
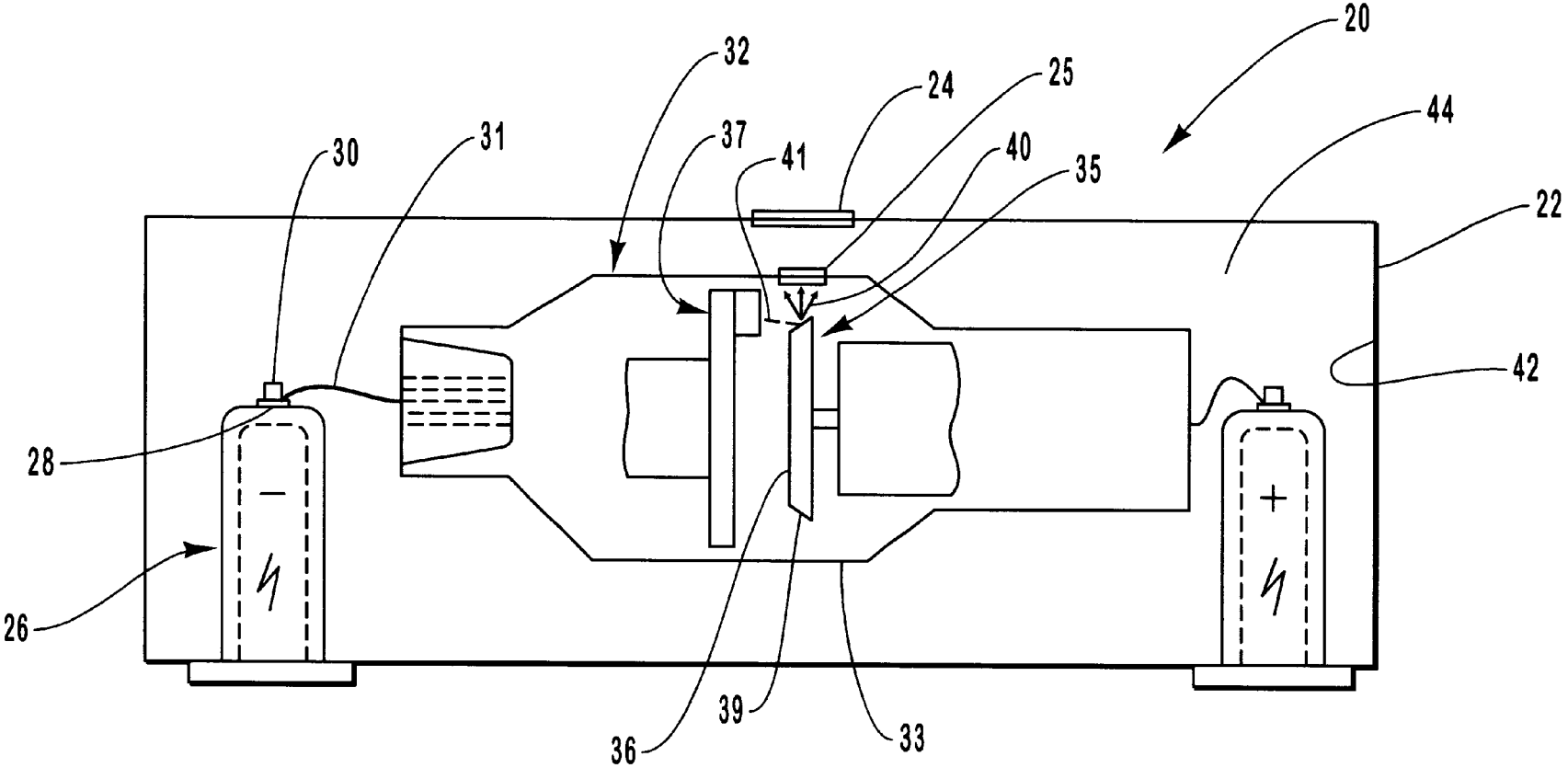
FIG. 1 is a simplified schematic cross-section of a typical x-ray device, including an exemplary view of a voltage receptacle.

Referring first to FIG. 1, a typical x-ray device, designated generally at 20, is shown in a simplified schematic cross-section. Device 20 includes an x-ray tube housing 22, sometimes referred to as the "can," which has a transmission window 24 that allows "on-focus" x-rays to pass through. At least one high voltage receptacle, such as that designated at 26, is provided to accommodate a high voltage electrical connection to the x-ray tube housing 22. By way of example, the high voltage receptacle 26 can include a feedthrough means 28 to accommodate high voltage leads, and a connection means 30 to electrically connect the high voltage leads 31 of the high voltage connector to an x-ray tube 32 disposed in tube housing 22. With the exception of a high voltage receptacle 26, described in detail below, the components and materials of x-ray device 20 are conventional, and can be any components and materials known in the art to be suitable for use in x-ray generating devices. Moreover, it will be appreciated that while FIG. 1 illustrates a specific type of x-ray device configuration, the present invention will be equally applicable to devices having different housing configurations and/or electrical orientations and in which radiation shielding is required.

By way of example, FIG. 1 shows an x-ray device 20 with an anode assembly 35 and a spaced apart cathode assembly 37, both of which are disposed within the evacuated housing 33 of the x-ray tube 32. The evacuated housing 33 is disposed within the outer tube housing 22 (or can), and the space 44 surrounding the x-ray tube 32 can be filled with an appropriate coolant, such as a dielectric oil, air or some other coolant medium. The anode assembly 35 includes, for example, a rotating anode target 36 having a target track 39. The anode assembly 35 and the cathode assembly 37 are connected within an electrical circuit that allows for the application of a voltage potential between the anode (positive) and cathode (negative). The high voltage potential causes a thin stream of electrons (indicated at 41) that are emitted from a filament portion of the cathode (not shown) to accelerate towards a focal spot 38 located in the anode target track 39. X-rays 40 are emitted from focal spot 38 when the high-energy electrons strike the focal spot 38. As is shown in the figure, the "on-focus" x-rays 40 pass through a transmission window 25 formed through the evacuated housing 33 and then through the transmission window 24, where they can be directed toward an object to be analyzed, such as an area of a patient's body.

However, due to a variety of circumstances some of the x-rays are "off-focus," and are emitted in other directions. These x-rays can be hazardous to persons operating the x-ray device. To prevent their emission, the tube housing 22 is typically lined with an x-ray absorbing layer 42, such as lead, and/or is equipped with appropriately positioned shield structures, also constructed with x-ray absorbing materials.

Figure 2:
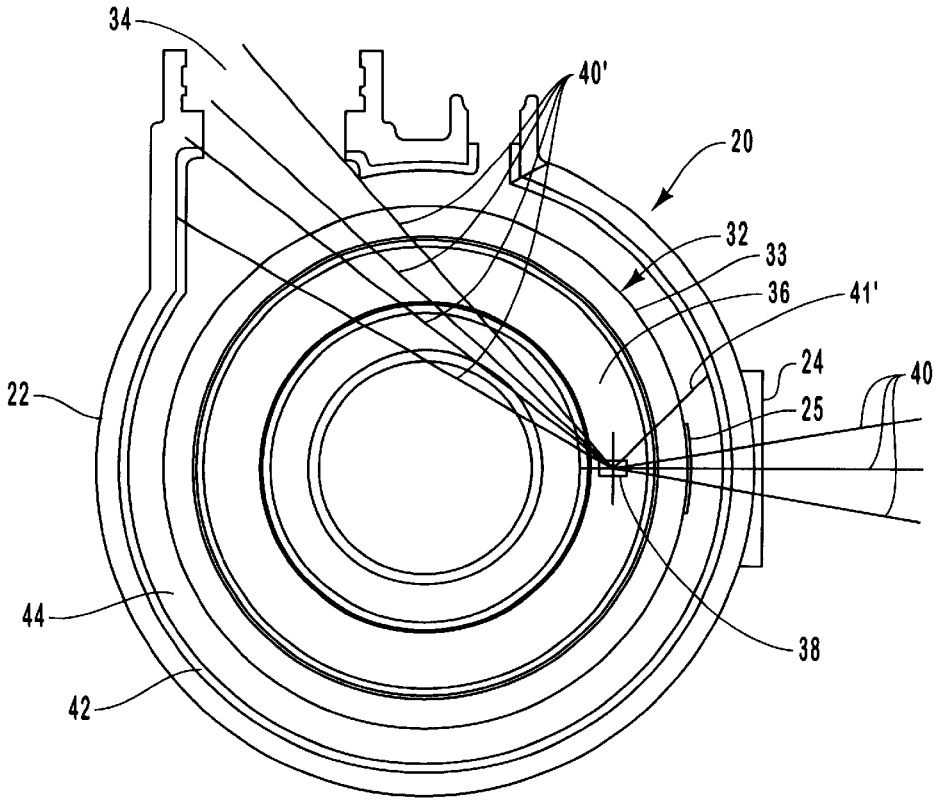
FIG. 2 is another schematic cross-section of an x-ray device illustrating additional details relating to embodiments of the present invention.

Reference is next made to FIG. 2, which illustrates in further detail the manner by which x-rays may be emitted from the x-ray tube 32. For example, as noted, some of the emitted x-rays 40 are considered to be on-focus, and are directed along paths which pass through x-ray windows 24 and 25. Other off-focus x-rays, such as those indicated at 41', A are directed to other areas of the x-ray device 20. Some of these x-rays may be absorbed by a liner 42 (or similar shielding structure), positioned within the interior of the outer housing 22. However, some of the off-focus x-rays 41 are emitted in a direction such that they are emitted through openings formed in the housing 22, such as the opening 34 that is provided for mounting an electrical receptacle 26. These x-rays pose a danger to persons in the vicinity of the x-ray device 20. Moreover, a standard dielectric voltage receptacle will not prevent the emission of such focus x-rays.

Figure 3:
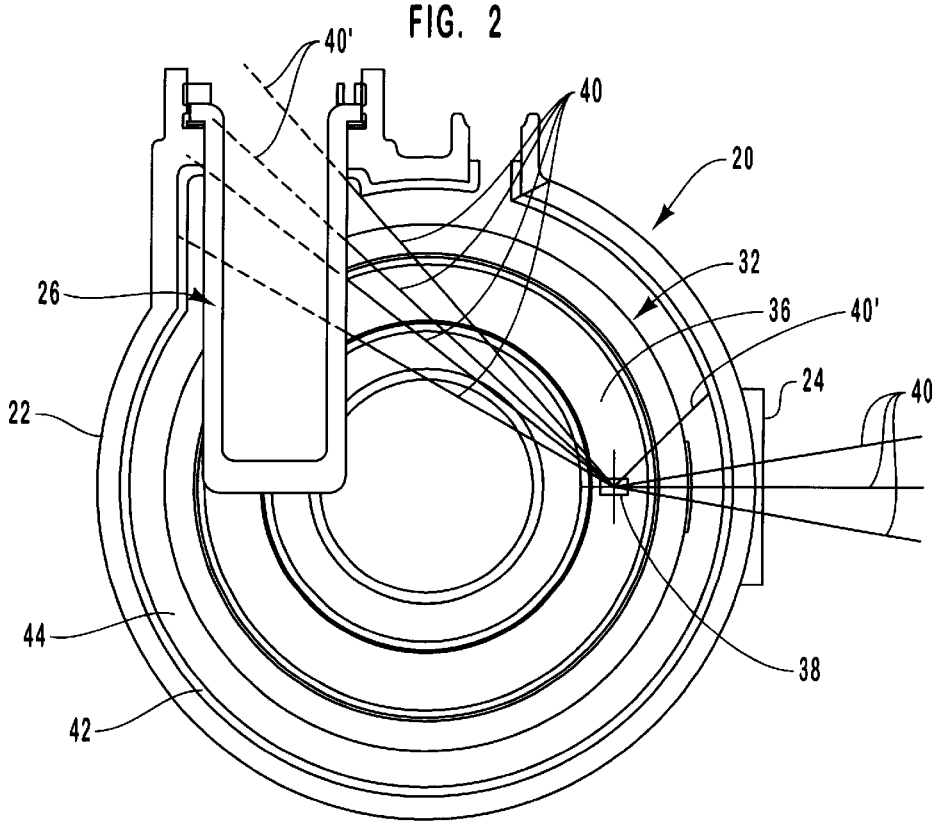
FIG. 3 is a schematic cross-section of the x-ray device of FIG. 2 with the high voltage receptacle in place.

FIG. 3 shows the device of FIG. 2 with one presently preferred embodiment of a high voltage receptacle 26 in place (feedthrough means 28 and connecting means 30 are not shown). In presently preferred embodiments, the voltage receptacle 26 is provided with both dielectric and radiation attenuating properties. This prevents the passage of off-focus x-rays through the opening 34. In preferred embodiments, the radiation attenuating property is provided in a manner that does not require a separate lead liner and/or shield structure.

Figure 4A:
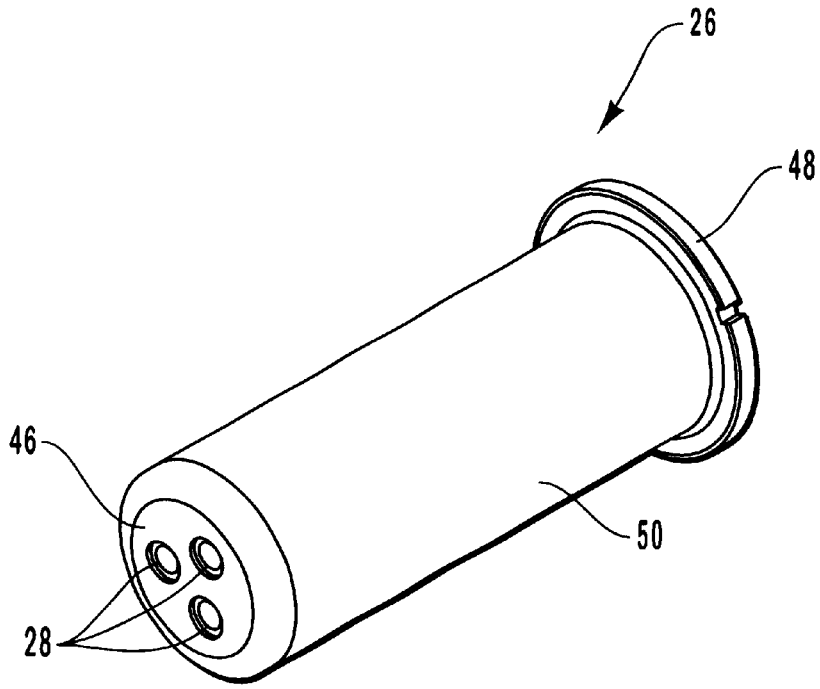
FIGS. 4A and 4B are perspective and cross-sectional views, respectively, of a high voltage receptacle according to the present invention.
Figure 4B:
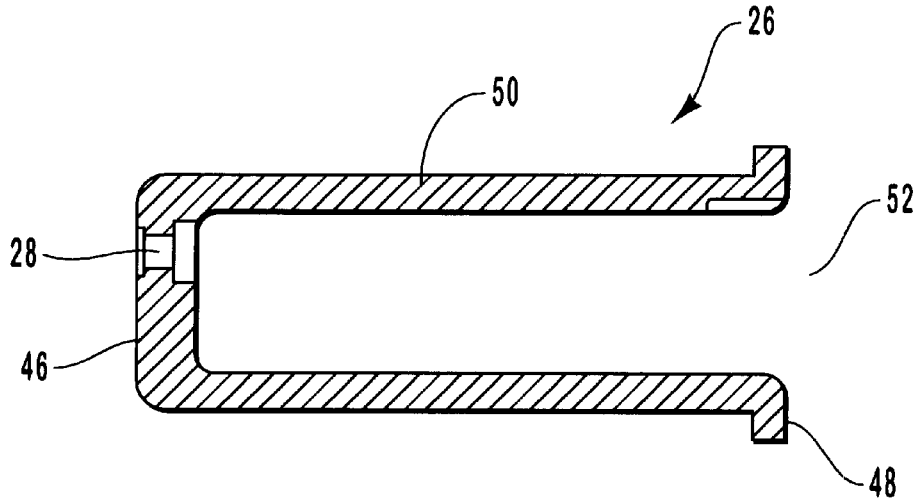

FIGS. 4A and 4B illustrate how a presently preferred embodiment the high voltage receptacle 26 includes a base portion 46 having feedthrough means 28 to allow connection of a high voltage connector in the receptacle to the x-ray tube. The receptacle 26 further includes a top portion 48 having an opening 52 that is sized and shaped so as to accommodate a high voltage electrical connector, and a sidewall portion 50 extending between the base portion 46 and the top portion 48. At least a portion of the high voltage receptacle 26 is formed from a material having both dielectric properties and x-ray attenuating properties, so that x-rays striking the high-voltage receptacle 26 are absorbed or scattered, and do not pass through the opening 34.

Typical high voltage receptacles are formed from any of a variety of thermoset plastics that have good dielectric properties. Such plastics must meet the NEMA (National Electrical Manufacturers Association) XR7-1995 High Voltage X-ray Cable Assemblies and Receptacle standards, and suitable plastics are well-known in the art. It has been surprisingly found that these dielectric plastics, which have essentially no x-ray attenuating properties, can be "doped" or filled with x-ray attenuating metal-containing compounds, to provide both dielectric and radiation attenuating properties to a high voltage receptacle formed therefrom.

The dielectric material can be any material which can be injection molded or cast to form a high voltage receptacle meeting NEMA standards, such as materials conventionally used in prior art high voltage receptacles. Examples of suitable materials include diallyl phthalate based materials, such as the commercially available RXI-50IN diallyl phthalate (Rogers). Other examples include urethanes, such as injection moldable urethanes H253P2, H253P3 and H253P4 (Parker Medical) and castable urethanes H253P1 and H253P5. One skilled in the art can readily identify other suitable materials which meet the NEMA standards. Typically the high voltage receptacle 26 is molded or cast as a single piece, although it can be formed of several pieces and assembled to form the completed receptacle, if desired.

The x-ray attenuating material is a metal containing compound which is capable of being incorporated into the high voltage receptacle in an amount sufficient to absorb or scatter at least a portion of the x-rays striking the receptacle, without compromising the structural and dielectric properties of the receptacle as measured by continued adherence to the NEMA standard. Examples of such materials include metal oxides and metal sulfates, particularly oxides and sulfates of metals having an atomic number greater than about 37. Metals suitable for use in the present invention include lead, bismuth, barium, tellurium and strontium. Thus, preferred x-ray attenuating materials are lead oxide, bismuth oxide, barium sulfate, tellurium oxide and strontium sulfate. It should be appreciated that these particular compounds are merely exemplary, and not limiting. Mixtures of two or more metal-containing compounds can also be used, if desired.

The metal containing compound can be incorporated into the high voltage receptacle by combining the metal compound with the dielectric material before casting or injection molding the high voltage receptacle. Thus, the specific dielectric material and x-ray attenuating material should be chosen so that a mixture of the dielectric material or its chemical precursors and the x-ray attenuating material is capable of being injection molded or cast. The amount of x-ray absorbing material to be used can vary, depending upon a variety of factors, such as the amount of radiation attenuation desired, the cross-sectional area of the part to be manufactured, the specific radiation attenuating properties of the metal-containing compound, and the x-ray tube power levels involved. Preferably, the x-ray attenuating material is present in an amount sufficient to allow the high voltage receptacle to pass standard radiation leakage tests in accordance with federal Food and Drug Administration (FDA) and Center for Devices and Radiological Health (CDRH) standards.

As noted above, the high voltage receptacle can be formed as a single unit, or can be formed in several sections which are assembled to form the completed unit. Preferably, the high voltage receptacle is formed of a single unit, and the dielectric material and x-ray attenuating material are uniformly distributed throughout the receptacle. However, if the receptacle is formed of several pieces which are then assembled, the x-ray attenuating material need only be present in those portions of the receptacle which are exposed to x-rays directed along paths which would otherwise escape the x-ray device.

Although the high voltage receptacle 26 shown in the Figures has an approximately tubular or cylindrical shape, the shape of the receptacle is not critical, and the receptacle can be configured as desired to properly attach to an x-ray tube housing, while still accommodating a high voltage connector. Feedthrough means 28 can be a plurality of holes as shown, with the specific number of holes and the shape of the holes being determined by the corresponding structures on the high voltage connector. Connecting means 30 can be any means conventionally used to connect the high voltage connector to an x-ray tube, and such means are well known in the art.

Figure 5:
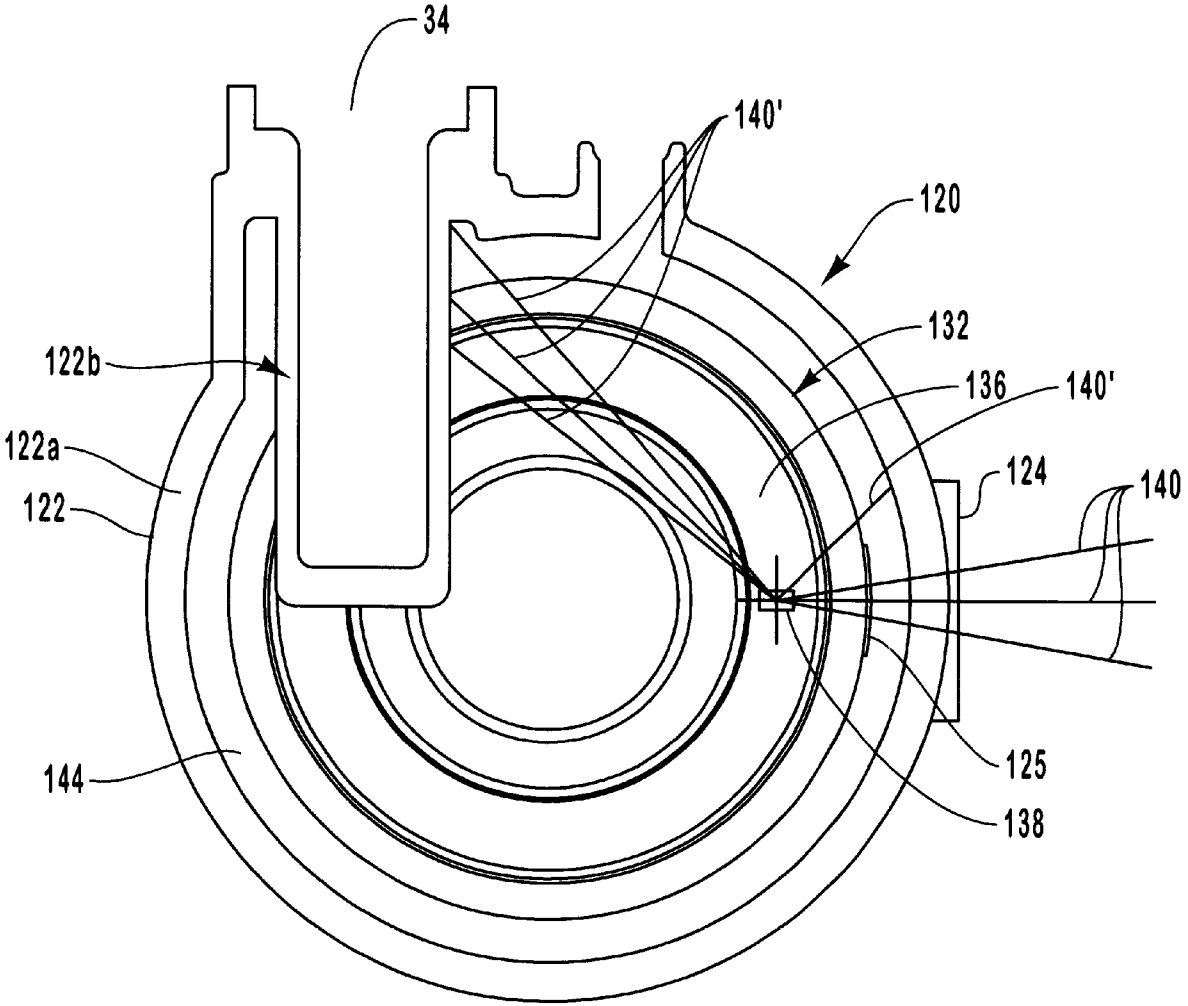
FIG. 5 is a schematic cross-section of an x-ray device according to the present invention.

In another embodiment, the present invention is directed to an x-ray tube housing assembly, which is shown in FIG. 5. In this embodiment, the assembly 120 includes an x-ray tube housing 122 that is configured in a manner similar to that described above. However, in this embodiment, the x-ray tube housing 122 includes at least a portion 122*a* that is formed integrally with the high voltage receptacle 122*b* and is thus comprised of the same material having both dielectric and radiation attenuating properties. Thus, rather than using a separate high voltage receptacle adapted to attach to an x-ray tube housing, the high voltage receptacle 122*b* is formed with at least a portion of the tube housing portion 122*a* as a single piece. The dielectric materials and x-ray attenuating materials can be those described above. In this embodiment, the need for lead shielding lining the inside of the tube housing is reduced or eliminated, since at least a portion of the tube housing is formed of a dielectric/x-ray attenuating material. In addition, the cost of producing such x-ray tube housing assemblies is reduced, since there are fewer part and associated connectors, such as washers, seals, rings and the like typically used to connect the high voltage receptacle to the tube housing. In some embodiments, the entire outer housing portion may be formed from the material used in the receptacle, thereby completely eliminating the need for a lead liner.

In addition to the advantages described above, various embodiments of the present invention also provide the additional advantage of reduced cost in designing and manufacturing additional parts that would otherwise be needed to shield radiation from exiting through the receptacle opening. Further, the devices of the present invention require less handling of lead parts by assembly personnel, which reduces the health risks associated with lead materials. Moreover, the reduction in use of lead (or similar) materials minimizes the amount that must later be disposed of, thereby reducing the amount of hazardous materials present in the environment, and the costs associated with hazardous waste disposal. In addition, it will be appreciated that while the embodiments shown above illustrate the high voltage receptacle in specific x-ray tube configurations, that others may also be used. Also, the embodiments illustrated show a receptacle implemented in an outer x-ray tube housing (such as 22 in FIG. 1). However, the receptacle could also be implemented in x-ray tubes having a single integral housing, such as that shown in co-pending applications Ser. No. 09/609,615 entitled "X-Ray Generating Apparatus" and Ser. No. 09/449,441 entitled "Mammography X-Ray Tube Having an Integral Housing Assembly," both of which are incorporated herein by reference.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A high voltage receptacle for use in an x-ray generating device, the receptacle comprising:

(a) a base portion having feedthrough means to allow connection of a high voltage conductor to an x-ray tube;

(b) a top portion having an opening therein to accommodate the high voltage electrical conductor; and (c) a sidewall portion extending between the base portion and the top portion, wherein at least a portion of the receptacle comprises a dielectric material and an x-ray attenuating material.

2. The receptacle of claim 1, wherein the x-ray attenuating material is present in an amount sufficient to substantially prevent x-ray radiation from passing through the receptacle when the receptacle is used in an x-ray device.

3. The receptacle of claim 1, wherein at least a portion of the receptacle is formed of a thermoset plastic dielectric material doped with an x-ray attenuating material.

4. The receptacle of claim 1, wherein the receptacle is formed of a thermoset plastic dielectric material doped with an x-ray attenuating material.

5. The receptacle of claim 3, wherein the dielectric material and x-ray attenuating material are chosen so that a mixture of the dielectric material or its chemical precursors and the x-ray attenuating material is capable of being injection molded or cast to form the at least a portion of the receptacle.

6. The receptacle of claim 4, wherein the dielectric material and x-ray attenuating material are chosen so that a mixture of the dielectric material or its chemical precursors and the x-ray attenuating material is capable of being injection molded or cast to form the receptacle.

7. The receptacle of claim 1, wherein the x-ray attenuating material is a metal-containing compound or a mixture thereof.

8. The receptacle of claim 1, wherein the x-ray attenuating material is a metal oxide or a mixture of metal oxides, a metal sulfate or a mixture of metal sulfates, or a mixture thereof.

9. The receptacle of claim 1, wherein the x-ray attenuating material is a compound of a metal having an atomic number greater than 37.

10. The receptacle of claim 1, wherein the x-ray attenuating material is a compound of lead, bismuth, barium, tellurium or strontiuim, or a mixture thereof.

11. The receptacle of claim 1, wherein the x-ray attenuating material is lead oxide, bismuth oxide, barium sulfate, tellurium oxide, strontium sulfate, or a mixture thereof.

12. A high voltage receptacle for a high voltage electrical connector, the receptacle comprising:

(a) a base portion having feedthrough means to allow connection of a high voltage connector in the receptacle to an x-ray tube;

(b) a top portion having an opening therein to accommodate the high voltage electrical connector; and (c) a sidewall portion extending between the base portion and the top portion, wherein the receptacle is formed of a mixture of a thermoset plastic dielectric material and an x-ray attenuating material.

13. The receptacle of claim 12, wherein the x-ray attenuating material is present in an amount sufficient to substantially prevent x-ray radiation from passing through the receptacle when the receptacle is used in an x-ray device.

14. The receptacle of claim 12, wherein the x-ray attenuating material is a metal-containing compound or a mixture thereof.

15. The receptacle of claim 12, wherein the x-ray attenuating material is a metal oxide or a mixture of metal oxides, a metal sulfate or a mixture of metal sulfates, or a mixture thereof.

16. The receptacle of claim 12, wherein the x-ray attenuating material is a compound of lead, bismuth, barium, tellurium or strontiuim, or a mixture thereof.

17. The receptacle of claim 12, wherein the x-ray attenuating material is lead oxide, bismuth oxide, barium sulfate, tellurium oxide, strontium sulfate, or a mixture thereof.

18. An x-ray tube housing assembly comprising:

(a) an x-ray tube housing adapted to contain an x-ray tube; and (b) a high voltage receptacle adapted to accommodate a high voltage electrical connector to provide an electrical connection to the x-ray tube, wherein the high voltage receptacle is formed of a mixture of a thermoset plastic dielectric material and an x-ray attenuating material.

19. The x-ray tube housing assembly of claim 18, wherein at least a portion of the x-ray tube housing and the high voltage receptacle are formed as a unitary structure from the mixture of the thermoset plastic dielectric material and the x-ray attenuating material.

20. The receptacle of claim 18, wherein the x-ray attenuating material is present in an amount sufficient to substantially prevent x-ray radiation from passing through the receptacle when the receptacle is used in an x-ray device.

21. The receptacle of claim 18, wherein the x-ray attenuating material is a metal-containing compound or a mixture thereof.

22. The receptacle of claim 18, wherein the x-ray attenuating material is a metal oxide or a mixture of metal oxides, a metal sulfate or a mixture of metal sulfates, or a mixture thereof.

23. The receptacle of claim 18, wherein the x-ray attenuating material is a compound of lead, bismuth, barium, tellurium or strontiuim, or a mixture thereof.

24. The receptacle of claim 18, wherein the x-ray attenuating material is lead oxide, bismuth oxide, barium sulfate, tellurium oxide, strontium sulfate, or a mixture thereof.

* * * * *

UNITED STATES PATENT AND TRADEMARK OFFICE

CERTIFICATE OF CORRECTION

PATENT NO. : 6,494,618 B1
DATED : December 17, 2002
INVENTOR(S) : Paul C. Moulton It is certified that error appears in the above-identified patent and that said Letters Patent is hereby corrected as shown below:

Column 1,
Line 62, delete “a”

Column 3,
Line 1, change “hi” to -- In --

Column 6,
Line 48, change “part” to -- parts --

Column 7,
Line 66, change “strontiuim” to -- strontium --

Column 8,
Lines 29 and 61, change “strontiuim” to -- strontium --

Signed and Sealed this

Eighth Day of April, 2003

JAMES E. ROGAN
*Director of the United States Patent and Trademark Office*